US008548340B2

(12) United States Patent
Tomiyasu

(10) Patent No.: US 8,548,340 B2
(45) Date of Patent: Oct. 1, 2013

(54) IMAGE-FORMING DEVICE CONFIGURED TO IDENTIFY A CHARGER AT WHICH AN ABNORMAL DISCHARGE IS OCCURRING

(75) Inventor: Miki Tomiyasu, Nagoya (JP)

(73) Assignee: Brother Kogyo Kabushiki Kaisha, Nagoya-shi (JP)

( * ) Notice: Subject to any disclaimer, the term of this patent is extended or adjusted under 35 U.S.C. 154(b) by 294 days.

(21) Appl. No.: 13/073,184

(22) Filed: Mar. 28, 2011

(65) Prior Publication Data

US 2012/0051761 A1 Mar. 1, 2012

(30) Foreign Application Priority Data

Aug. 31, 2010 (JP) ..... 2010-195028

(51) Int. Cl.
*G03G 15/02* (2006.01)
*G03G 21/00* (2006.01)

(52) U.S. Cl.
USPC ..... 399/31; 399/50; 399/168

(58) Field of Classification Search
USPC ..... 399/31, 9, 50, 168, 170
See application file for complete search history.

(56) References Cited

U.S. PATENT DOCUMENTS

| | | | | |
|---|---|---|---|---|
| 8,019,241 | B2 | 9/2011 | Hamaya | |
| 2007/0147858 | A1 | 6/2007 | Inukai | |
| 2009/0010661 | A1 | 1/2009 | Hamaya | |
| 2009/0060535 | A1 | 3/2009 | Hamaya | |
| 2010/0080592 | A1 | 4/2010 | Hamaya et al. | |
| 2010/0080593 | A1 | 4/2010 | Inukai et al. | |
| 2012/0082470 | A1 * | 4/2012 | Inukai et al. | 399/31 |

FOREIGN PATENT DOCUMENTS

| | | | |
|---|---|---|---|
| JP | 2006-184826 | A | 7/2006 |
| JP | 2007-178595 | | 7/2007 |
| JP | 2009-015168 | | 1/2009 |
| JP | 2009-053422 | A | 3/2009 |
| JP | 2010-079045 | | 4/2010 |
| JP | 2010-102289 | A | 5/2010 |

* cited by examiner

*Primary Examiner* — Sophia S Chen
(74) *Attorney, Agent, or Firm* — Banner & Witcoff, Ltd.

(57) ABSTRACT

In an image-forming device, each of the N chargers charges the opposed photoconductor with a discharge. The voltage applying unit applies voltages to the N chargers, individually. The abnormal discharge detecting unit detects an occurrence of an abnormal discharge at least one of the N chargers. The voltage detecting unit detects first voltages applied to the N chargers before the occurrence of the abnormal discharge is detected, and second voltages applied to the N chargers after the occurrence of the abnormal discharge is detected. The calculating unit calculates a difference between the first voltage and the second voltage for each of the N chargers. The identifying unit identifies one charger as a charger at which the abnormal discharge is occurring. The difference between the first voltage and the second voltage applied to the one charger is the greatest among the differences.

6 Claims, 9 Drawing Sheets

IMAGE-FORMING DEVICE CONFIGURED TO IDENTIFY A CHARGER AT WHICH AN ABNORMAL DISCHARGE IS OCCURRING

CROSS REFERENCE TO RELATED APPLICATION

This application claims priority from Japanese Patent Application No. 2010-195028 filed Aug. 31, 2010. The entire content of this application is incorporated herein by reference.

TECHNICAL FIELD

The present invention relates to an electrophotographic image-forming device including a plurality of chargers that charges a plurality of photoconductors, respectively.

BACKGROUND

An electrophotographic image-forming device capable of performing a multicolor printing includes a plurality of photoconductors and a plurality of chargers opposed to the plurality of photoconductors, respectively. When voltages are applied to the plurality of chargers, corona discharges occur at the plurality of chargers to charge the plurality of photoconductors. When a wire of the charger becomes contaminated with airborne (accumulated) dust particles or other contaminants around the charger, an abnormal discharge. Therefore, an image-forming device that, when detecting the occurrence of the abnormal discharge, acquires the voltages applied to the plurality of chargers, sequentially changes the voltages applied to the plurality of chargers, and identifies, based on the voltage changing result, the charger at which the abnormal discharge is occurring, is proposed.

SUMMARY

However, since the above image-forming device sequentially changes the voltages applied to the plurality of chargers, much time is taken for identifying the charger at which the abnormal discharge is occurring.

In view of the foregoing, it is an object of the invention to provide an image-forming device capable of identifying the charger at which the abnormal discharge is occurring immediately after detecting the occurrence of the abnormal discharge, without providing an abnormal discharge detecting unit for each charger.

In order to attain the above and other objects, the invention provides an image-forming device including N photoconductors, N chargers, a voltage applying unit, an abnormal discharge detecting unit, a voltage detecting unit, a calculating unit, and an identifying unit. The N is equal to or greater than 2. The N chargers are opposed to the N photoconductors, respectively. Each of the N chargers charges the opposed photoconductor with a discharge. The voltage applying unit applies voltages to the N chargers, individually. The abnormal discharge detecting unit detects an occurrence of an abnormal discharge at least one of the N chargers. The voltage detecting unit detects first voltages applied to the N chargers before the occurrence of the abnormal discharge is detected, and second voltages applied to the N chargers after the occurrence of the abnormal discharge is detected. The calculating unit calculates a difference between the first voltage and the second voltage for each of the N chargers. The identifying unit identifies one charger as a charger at which the abnormal discharge is occurring. The difference between the first voltage and the second voltage applied to the one charger is the greatest among the differences.

Another aspect of the present invention provides an image-forming device including N photoconductors, N chargers, a voltage applying unit, an abnormal discharge detecting unit, a voltage detecting unit, a calculating unit, an identifying unit. The N is equal to or greater than 3. The N chargers are opposed to the N photoconductors, respectively. Each of the N chargers charges the opposed photoconductor with a discharge. The voltage applying unit applies voltages to the N chargers, individually. The abnormal discharge detecting unit detects an occurrence of an abnormal discharge at least one of the N chargers. The voltage detecting unit detects voltages applied to the N chargers at an interval. The calculating unit that calculates a difference between a voltage applied to one charger and a voltage applied to another charger that are detected immediately before or after the occurrence of the abnormal discharge is detected. The identifying unit identifies two chargers as a charger at which the abnormal discharge is occurring. The difference between the voltages applied to the two chargers is the greatest among the differences.

Another aspect of the present invention provides an image-forming device including N photoconductors, N chargers, a voltage applying unit, an abnormal discharge detecting unit, an identifying unit. The N is equal to or greater than 2. The N chargers are opposed to the N photoconductors, respectively. Each of the N chargers charges the opposed photoconductor with a discharge. The voltage applying unit applies voltages to the N chargers, individually. The abnormal discharge detecting unit detects an occurrence of an abnormal discharge at least one of the N chargers. The voltage detecting unit detects voltages applied to the N chargers at an interval. The identifying unit identifies at least one charger as a charger at which the abnormal discharge is occurring. The voltage applied to the at least one charger is outside a range into which the voltage detected when the discharge is occurring falls.

BRIEF DESCRIPTION OF THE DRAWINGS

The particular features and advantages of the invention as well as other objects will become apparent from the following description taken in connection with the accompanying drawings, in which.

DETAILED DESCRIPTION

[Entire Configuration of Image Forming Device]

Figure 1:
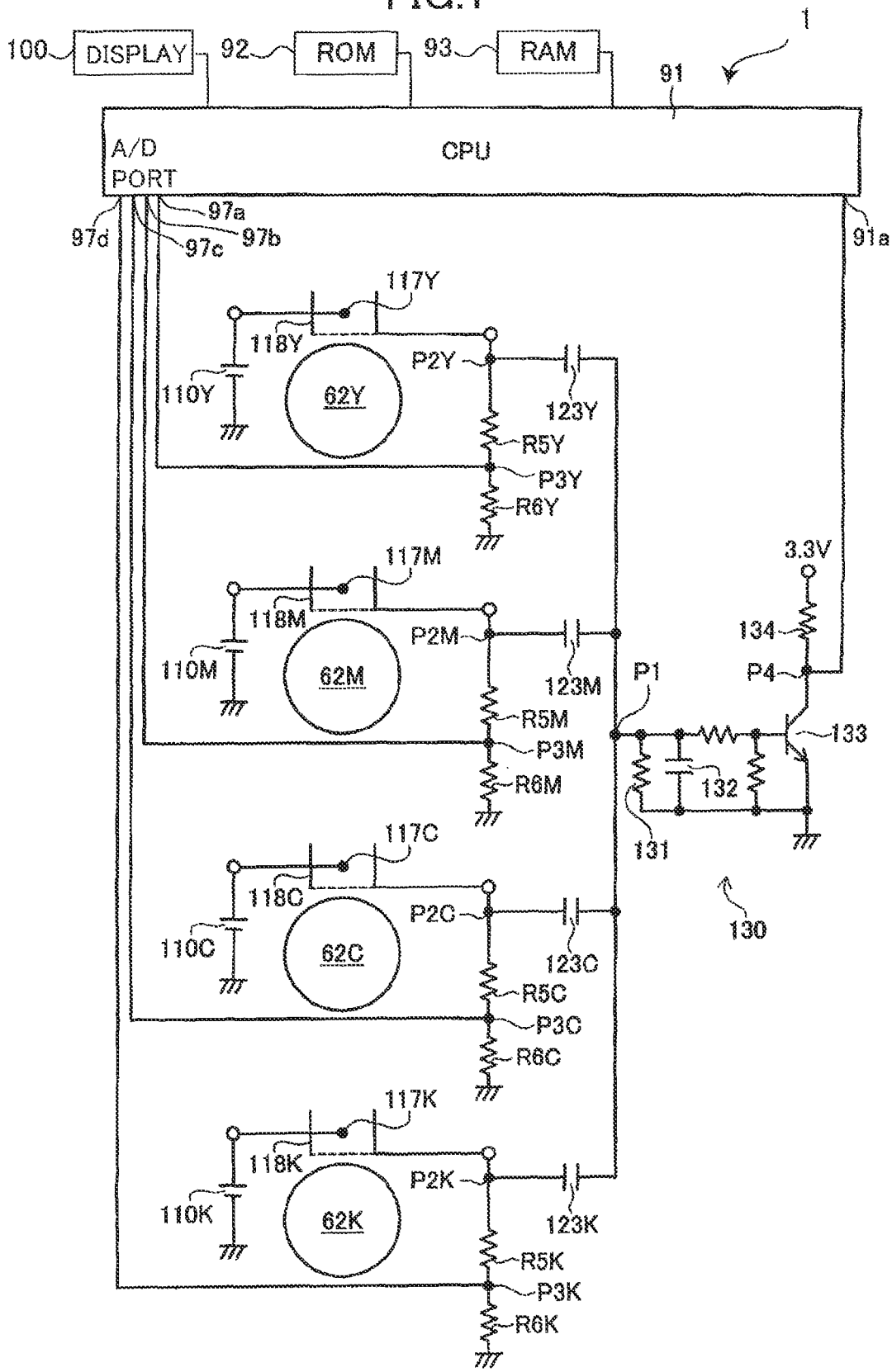
FIG. 1 is a block diagram showing an electrical configuration of an image-forming device according to a preferred embodiment of the present invention.

As shown in FIG. 1, an image forming device 1 according to the present embodiment has four photoconductors 62Y, 62M, 62C, and 62K corresponding to four colors of yellow (Y), magenta (M), cyan (C), and black (K), respectively.

The image forming device 1 is so-called a color laser printer that conveys a recording medium such as a paper by means of a belt (not illustrated) to form a color image on the recording medium that sequentially passes through the opposing parts between the belt and the photoconductors 62Y, 62M, 62C, and 62K. A CPU 91 for controlling components in the image forming device 1 is connected to a ROM 92 and a RAM 93 to constitute a microcomputer. The CPU 91 is also connected to a display unit 100 provided on the front surface of the casing of the image forming device 1. In the following explanation, the signs Y, M, C, and K representing the four colors are omitted except when necessary.

A charger 117 is a scorotron type charger having a wire at which a corona discharge occurs. The charger 117 is disposed opposite to the photoconductor 62 to uniformly charge the surface of the photoconductor 62 before an electrostatic latent image is formed on the photoconductor 62 by exposure. When a high voltage (e.g., 6000 V to 8000 V) is applied to the charger 117 by a high-voltage power supply unit 110, the corona discharge occurs at the charger 117. With the corona discharge, multiple ions are discharged to the photoconductor 62 from the charger 117 to the photoconductor 62 to charge the photoconductor 62.

A GRID portion 118 is also disposed between the photoconductor 62 and the charger 117 to detect the amount of the corona discharge. The multiple ions are also discharged to the GRID portion 118. Due to the multiple ions, a current flows into the GRID portion 118. For example, when the corona discharge normally occurs at the charger 117, a current of 275 μA flows into the GRID portion 118.

The GRID portions 118Y, 118M, 118C, and 118K output the current generated due to the multiple ions toward connection points P2Y, P2M, P2C, and P2K. To each of the connection points P2, a resistor R5 and a capacitor 123 are connected in parallel.

The capacitor 123 cuts a DC component of the current (voltage) at the connection point P2. Therefore, only a sharply increasing (an AC component) current, which is generated when an abnormal discharge, such as, an arc discharge occurs at the charger 117, flows toward a discharge detection circuit 130 through a common connection point P1. The single discharge detection circuit 130 is connected in common to the chargers 117Y, 117M, 117C, and 117K. The discharge detection circuit 130 detects, based on the current, that the abnormal discharge occurs at any one of the chargers 117Y, 117M, 117C, and 117K.

The discharge detection circuit 130 includes resistors 131 and 134, a capacitor 132, and a transistor 133. The resistor 131, the capacitor 132, and the transistor 133 are connected to the connection point P1 in parallel. The resistor 131 adjusts the voltage to be applied to the connection point P1. The capacitor 132 decreases a peak value of the voltage to be applied to the connection point P1. In other words, the capacitor 132 absorbs the influence of the noise. Therefore, the voltage from which the influence of the noise has been absorbed is applied to the transistor 133.

An emitter of the transistor 133 is connected to the ground, a collector of the transistor 133 is connected to a power supply (3.3V in the preferred embodiment) through the resistor 134, and a base of the transistor 133 is connected to the connection point P1. The resistor 134 is a pull-up resistor. A connection point P4 provided between the transistor 133 and the resistor 134 is further connected to a discharge detection signal input port 91*a* provided in the CPU 91.

The CPU 91 determines, based on the voltage inputted into the discharge detection signal input port 91*a*, whether or not the abnormal discharge is occurring. Specifically, when a voltage smaller than an on-voltage of the transistor 133 is applied to the base of the transistor 133, the transistor 133 is turned OFF. When the transistor 133 is turned OFF, the voltage of the connection point P4 becomes approximately 3.3 V. When the 3.3V (a high signal, hereinafter, referred to as "H") is inputted into the discharge detection signal input port 91*a*, the CPU 91 determines that the abnormal discharge is not occurring at any one of the chargers 117Y, 117M, 117C, and 117K.

On the other hand, a voltage equal to or greater than the on-voltage of the transistor 133 is applied to the base of the transistor 133, the transistor 133 is turned ON. When the transistor 133 is turned ON, a current flows between the collector and emitter of the transistor 133, thereby the voltage of the connection point P4 becomes 0V. When the 0V (a low signal, hereinafter, referred to as "L") is inputted into the discharge detection signal input port 91*a*, the CPU 91 determines that an abnormal discharge is occurring at any one of the chargers 117Y, 117M, 117C, and 117K. Hereinafter, this process is referred to as an abnormal-discharge detecting process.

The terminal of the resistor R5 on the opposite side to the connection point P2 is connected to a resistor R6. A connection point P3 provided between the resistors R5 and R6 is connected to A/D port 97 (97*a*, 97*b*, 97*c*, and 97*d*) of the CPU 91. The terminal of the resistor R6 on the opposite side to the connection point P3 is connected to the ground. Hereinafter, when it is not necessary to distinguish the first to fourth A/D ports 97*a*, 97*b*, 97*c*, and 97*d* of the CPU 91 from each other, they are collectively referred to as "A/D port 97."

Figure 2:
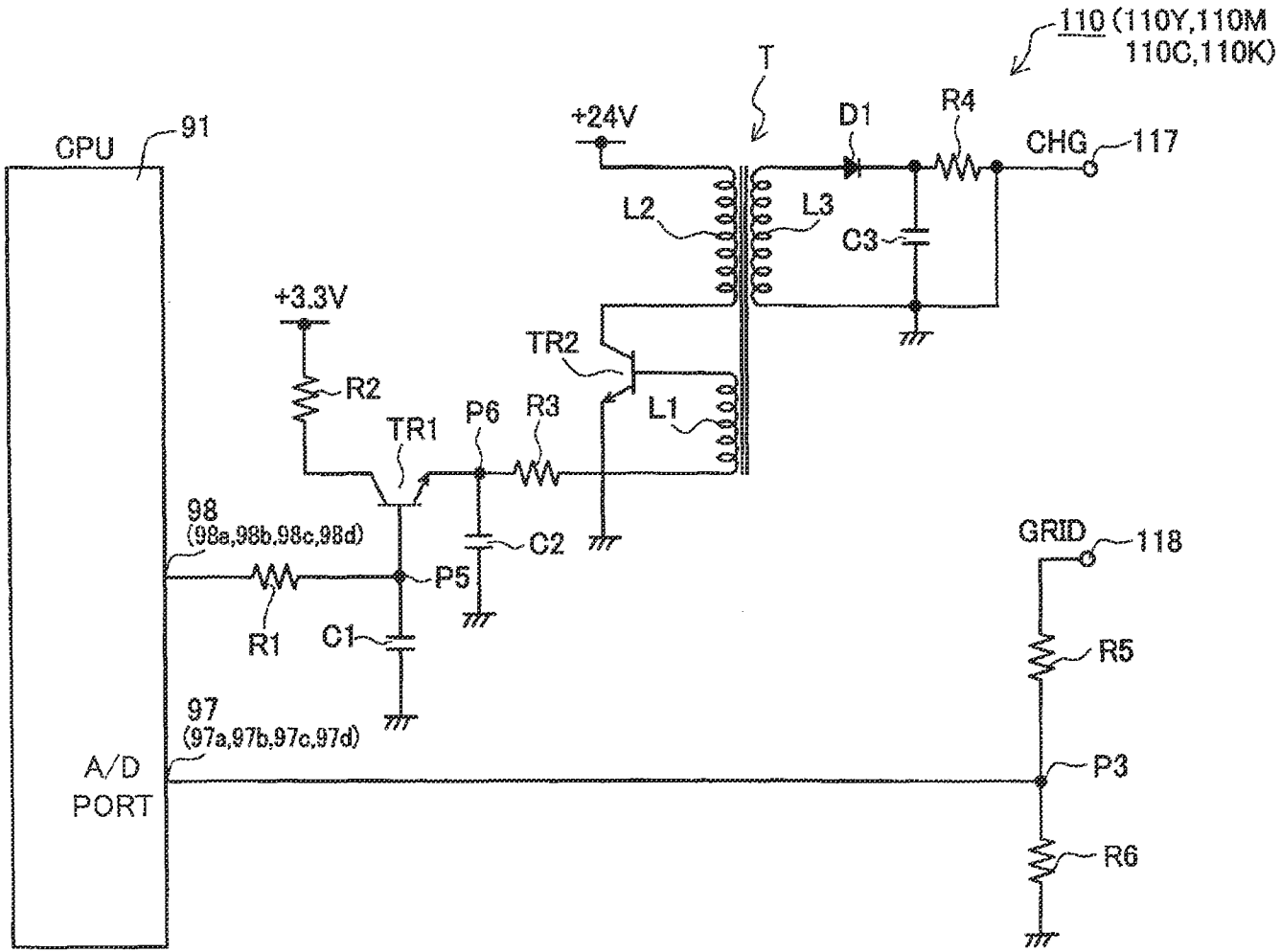
FIG. 2 is a block diagram showing a configuration of a high-voltage power supply unit according to the preferred embodiment.

As shown in FIG. 2, the CPU 91 outputs, from a control information output port 98 (98*a*, 98*b*, 98*c*, and 98*d*), a PWM control signal corresponding to the voltage inputted into the A/D port 97. Specifically, the CPU 91 outputs the PWM control signal such that the voltage of the GRID portion 118 becomes constant. When the voltage of the GRID portion 118 becomes constant, the charge voltage of the photoconductor 62 becomes constant. Hereinafter, this process is referred to as a high-voltage application process.

For example, when the amount of the current flowing into the GRID portion 118 is small, that is, the voltage of the GRID portion 118 is low, it is considered that the voltage applied to the photoconductor 62 is low. Therefore, in such case, the CPU 91 increases the duty value of the PWM control signal to increase the voltage applied to the charger 117 from the high-voltage power supply unit 110. On the other hand, when the amount of the current flowing into the GRID portion 118 is large, that is, the voltage of the GRID portion 118 is high, it is considered that the voltage applied to the photoconductor 62 is high. Therefore, in such case, the CPU 91 decreases the duty value of the PWM control signal to decrease the voltage applied to the charger 117 from the high-voltage power supply unit 110.

In theory, the voltage applied to the charger 117 from the high-voltage power supply unit 110 is proportional to the duty value of the PWM control signal. Accordingly, by calculating the duty value of the PWM control signal, the voltage applied to the charger 117 from the high-voltage power supply unit 110 can be detected.

Next, the high-voltage power supply unit 110 is explained with reference to FIG. 2. The high-voltage power supply units 110Y, 110M, 110C, and 110K are provided to correspond to the chargers 117Y, 117M, 117C, and 117K. Since the high-voltage power supply units 110Y, 110M, 110C, and 110K have the same configuration, only one high-voltage power supply unit 110 is illustrated in FIG. 2.

The control information output port 98 is connected to a base of a transistor TR1 of the high-voltage power supply unit 110 through a resistor R1. A connection point P5 between the resistor R1 and the transistor TR1 is also connected to the ground through a capacitor C1. The resistor R1 adjusts the voltage to be applied to the connection point P5 from the control information output port 98. The capacitor C1 smoothes the voltage applied to the base of the transistor TR1.

A collector of the transistor TR1 is connected to a power supply (3.3V in the preferred embodiment) through a resistor R2, and an emitter is connected to a resistor R3. A connection point P6 provided between the transistor TR1 and the resistor R3 is also connected to the ground through a capacitor C2. The terminal of the resistor R3 on the opposite side to the connection point P6 is connected to a base of a transistor TR2 through a coil L1.

When no voltage is applied to the base of the transistor TR1, the transistor TR1 is turned OFF. When the transistor TR1 is turned OFF, no voltage is applied to the base of the transistor TR2. Therefore, when no voltage is applied to the base of the transistor TR1, no current flows between the collector and emitter of the transistor TR2.

On the other hand, when a voltage is applied to the base of the transistor TR1, the transistor TR1 is turned ON. When the transistor TR1 is turned ON, a voltage is applied to the base of the transistor TR2. Therefore, when a voltage is applied to the base of the transistor TR1, a current flows between the collector and emitter of the transistor TR2. Note that the voltage output from the transistor TR1 is smoothed by the capacitor C2 and the resistor R3.

The collector of the transistor TR2 is connected to a primary coil L2 of a transformer T. When a current flows between the collector and emitter of the transistor TR2, the transformer T increases a voltage (e.g., 24 V) applied to the primary coil L2 from the power supply to, e.g., 6000 V to 8000 V in cooperation with a secondary coil L3. Thus, the transformer T outputs high-voltage AC power according to the switching operation of the transistor TR2.

The secondary coil L3 of the transformer T is connected to the charger 117 through a diode D1 and a resistor R4. An AC power outputted from the secondary coil L3 is rectified in the diode D1, then converted into a DC current by a capacitor C3, and subsequently supplied to the charger 117. The resistor R4 is a short-circuit protection resistor.

[Control Performed by CPU]

Next, the abnormal-discharge detecting process performed by the CPU 91 will be explained with reference to FIG. 3. The abnormal-discharge detecting process is started when a high-voltage application command is issued to the charger 117 when, for example, a warm-up or image formation process in the image forming device 1 is started.

Figure 3:
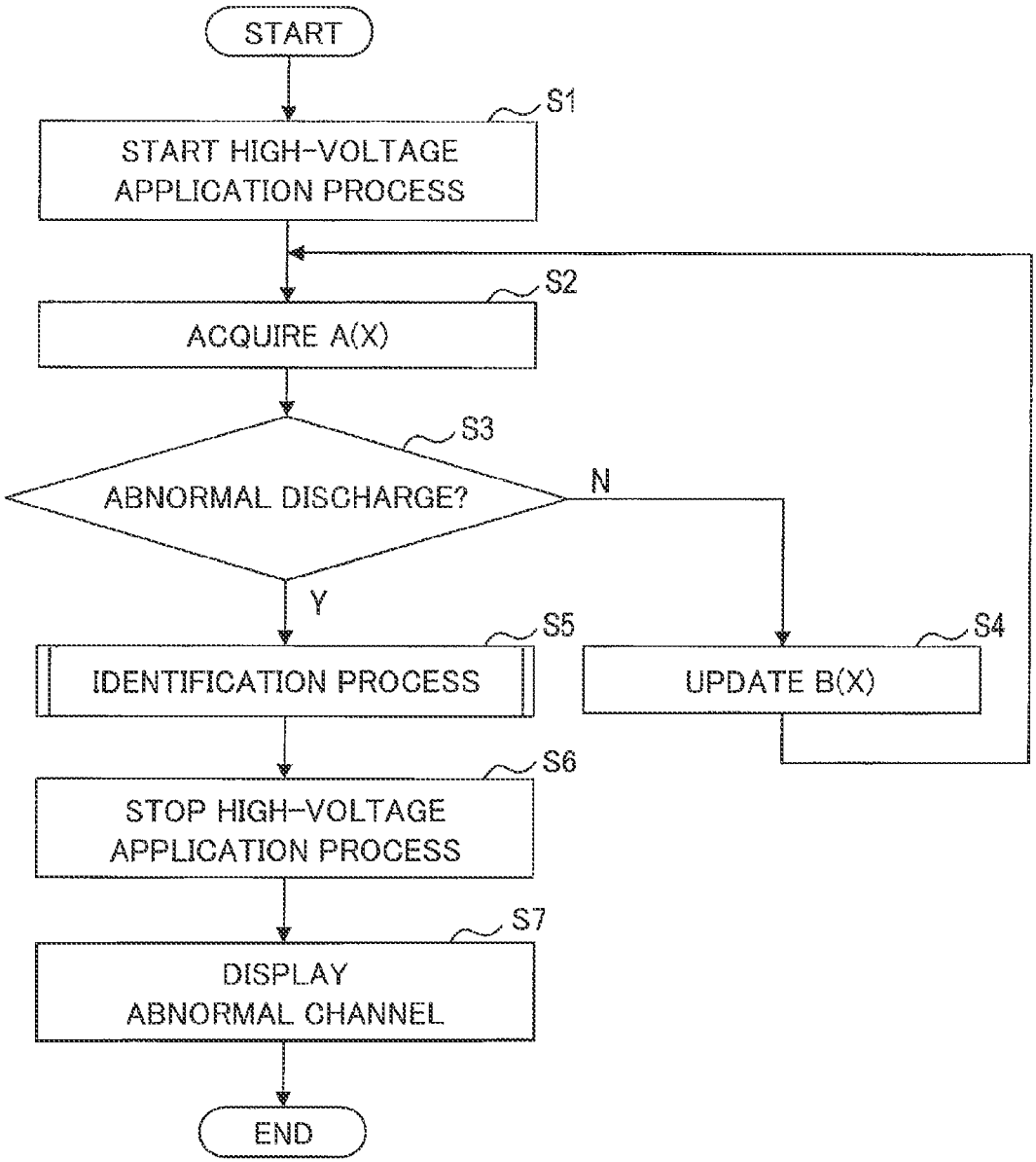
FIG. 3 is a flowchart showing a main routine of a CPU according to the preferred embodiment.

As shown in FIG. 3, in S1 (hereinafter, S represents "Step"), the CPU 91 starts the abovementioned high-voltage application process for the charger 117 in another routine. Subsequently, in S2, the CPU 91 acquires the PWM control signal (hereinafter referred also to as output level) outputted from each control information output port 98 or the voltage (hereinafter referred to as FB level) inputted into each A/D port 97, and stores the acquired output level or FB level as a present value A(x) in the RAM 93. The sign x is a channel number and takes values of 0, 1, 2, and 3 in correspondence with C, M, K, and Y, respectively. As described above, since there is a proportional relationship between the output level and the FB level, it makes no difference if the output level or the FB level is used in S2.

Subsequently, in S3, the CPU 91 determines whether or not the abnormal discharge is occurring, based on the discharge detection signal inputted into the discharge detection signal input port 91*a*. When the discharge detection signal is H, it is considered that the abnormal discharge is not occurring. Therefore, when the discharge detection signal is H (S3: N), in S4, the CPU 91 updates a previous value B(x) to the present value A(x) (the output level or the FB level stored in S2), and stores the updated previous value B(x) in RAM 93. Then, the processing flow shifts to the abovementioned S2. By repeating a loop from S2 to S4, the present value A(x) and the previous value B(x) stored in the RAM 93 for each channel number x are repeatedly updated.

On the other hand, when the discharge detection signal is L, it is considered that the abnormal discharge is occurring. Therefore, when the discharge detection signal is L (S3: Y), in S5, the CPU 91 identifies the abnormal channel (color) in which the abnormal discharge is occurring, based on both the present value A(x) and the previous value B(x) stored in the RAM 93 (identification process). The details of the identification process will be described later. Subsequently, in S6, the CPU 91 outputs the PWM control signal for stopping the application of the high-voltage to all the chargers 117. The order of S6 and S5 may be interchanged. Subsequently, in S7, the CPU 91 displays the abnormal channel determined in S5 on the display unit 100 and then ends the process.

[Identification Process of Discharge Channel]

Figure 4:
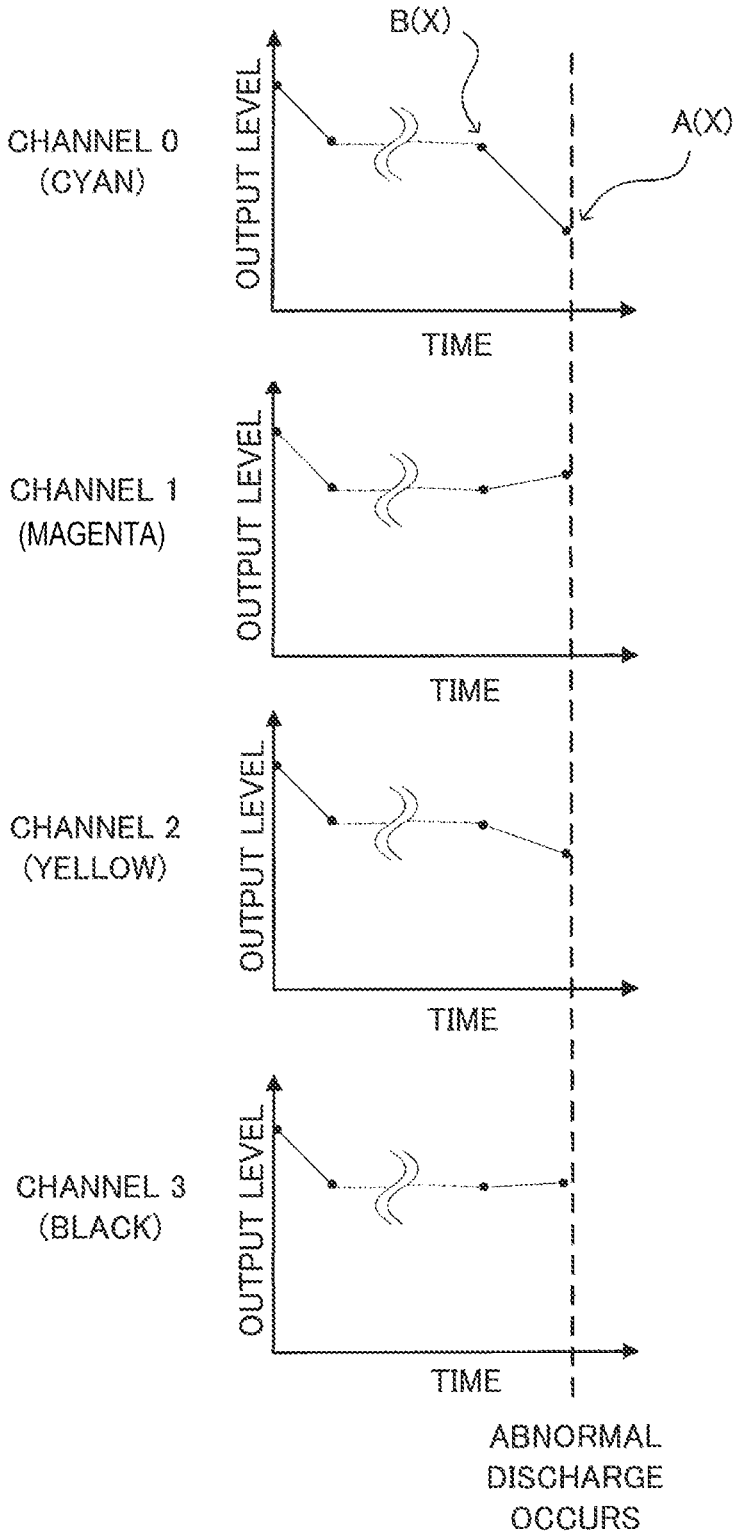
FIG. 4 is an explanation diagram showing a principle of an identification process according to the preferred embodiment.

Next, the principle of the identification process will be explained with reference to FIG. 4. In the preferred embodiment, as shown in FIG. 4, the output level is stored in the RAM 93 at regular time intervals. The FB level may be stored in the RAM 93 in place of the output level. Here, the output level significantly changes immediately before the abnormal discharge has occurred at the charger 117. In the example of FIG. 4, a larger difference is observed between the previous value B(x) and the present value A(x) in channel 0 (cyan) than is observed in other channels, which indicates that the abnormal discharge has occurred in channel 0.

Next, the identification process performed at S5 in FIG. 3 will be explained with reference to FIG. 5. Firstly, the channel number x is set to 0 in S51. In S52, it is determined whether or not the channel number x is less than 4. In the first time of S52, an affirmative determination is made (S52: Y) since the channel x has been set to 0 in S51, and the processing flow shifts to S53. In S53, a difference Y(x) (absolute value) between the previous value B(x) and present value A(x) is calculated. Subsequently, in S54, the channel number x is incremented by 1, and the processing flow shifts to the abovementioned S52. When the differences Y(x) of all of the channel numbers x (=0 to 3) are thus calculated (S53), a negative determination is made in S52 (S52: N), and the processing flow shifts to S55.

In S55, the channel number x is set to 0, a variation Zmax is set to a maximum value (an assumable maximum value of the difference Y(x)), and a variable ch is set to 0. In S56, it is determined whether or not the channel number x is less than 4. In the first time of S56, an affirmative determination is made (S56: Y) since the channel x has been set to 0 in S55, and the processing flow shifts to S57. In S57, it is determined whether or not the difference Y(x) (initially, Y(0)) is less than the variation Zmax. In the first time of S57, an affirmative determination is made (S57: Y) since the variation Zmax is initially set to the level maximum value in S55, and the processing flow shifts to S58. In S58, the variation Zmax is updated to the difference Y(x), and the variable ch is updated to the present channel number x. In S59, the channel number x is incremented by 1, and the processing shifts to the abovementioned S56. On the other hand, when it is determined in S57 that the difference Y(x) is not less than the variation Zmax (S57: N), the processing flow shifts to S59. When the processing of S56 to S59 for all the channel numbers x (=0 to 3) is terminated (S56: N), the channel number x corresponding to the largest difference Y(x) has been stored as the variable ch.

When a negative determination is made in S56 (S56: N), in S60, a channel corresponding to the channel number x stored as the variable ch is identified as the abnormal discharge channel, and the processing flow shifts to the abovementioned S6 of FIG. 3. Then, in S7 of FIG. 3, the charger 117 corresponding to the color of the channel that has been determined in S60 of FIG. 5 as the abnormal discharge channel is displayed on the display unit 100.

As described above, in the preferred embodiment, even though the single discharge detection circuit 130 is provided in common for the respective colors in order to reduce manufacturing cost, the charger 117 at which the abnormal discharge is occurring can be quickly identified after detecting the occurrence of the abnormal discharge.

In addition, in the preferred embodiment, a channel having the largest difference Y(x) between the previous value B(x) and the present value A(x) is identified as the abnormal discharge channel. Therefore, it is not required to previously set a threshold value for determining the abnormal discharge channel. Thus, even when the output level of the normal discharge changes with age, the charger 117 at which the abnormal discharge is occurring can be precisely identified.

Further, in the preferred embodiment, the charger 117 in which the abnormal discharge is occurring is displayed on the display unit 100. Therefore, a user has only to clean just the charger 117 displayed on the display unit 100.

[Variations of Present Invention]

While the invention has been described in detail with reference to the embodiment thereof, it would be apparent to those skilled in the art that various changes and modifications may be made therein without departing from the spirit of the invention.

For example, in FIG. 3, the present value A(x) may be acquired (S2) immediately after the detection of the abnormal discharge (S3: Y). Further, in S57 of FIG. 5, a configuration may be adopted in which the difference Y(x) is compared to a predetermined threshold, and all the channels having the difference Y(x) exceeding the threshold are identified as the discharge channels. In this case, it becomes possible to identify the chargers 117 at which the abnormal discharge is occurring even if the abnormal discharge is occurring in a plurality of the chargers 117 at the same time.

[Another Identification Processing of Discharge Channel (1)]

Figure 5:
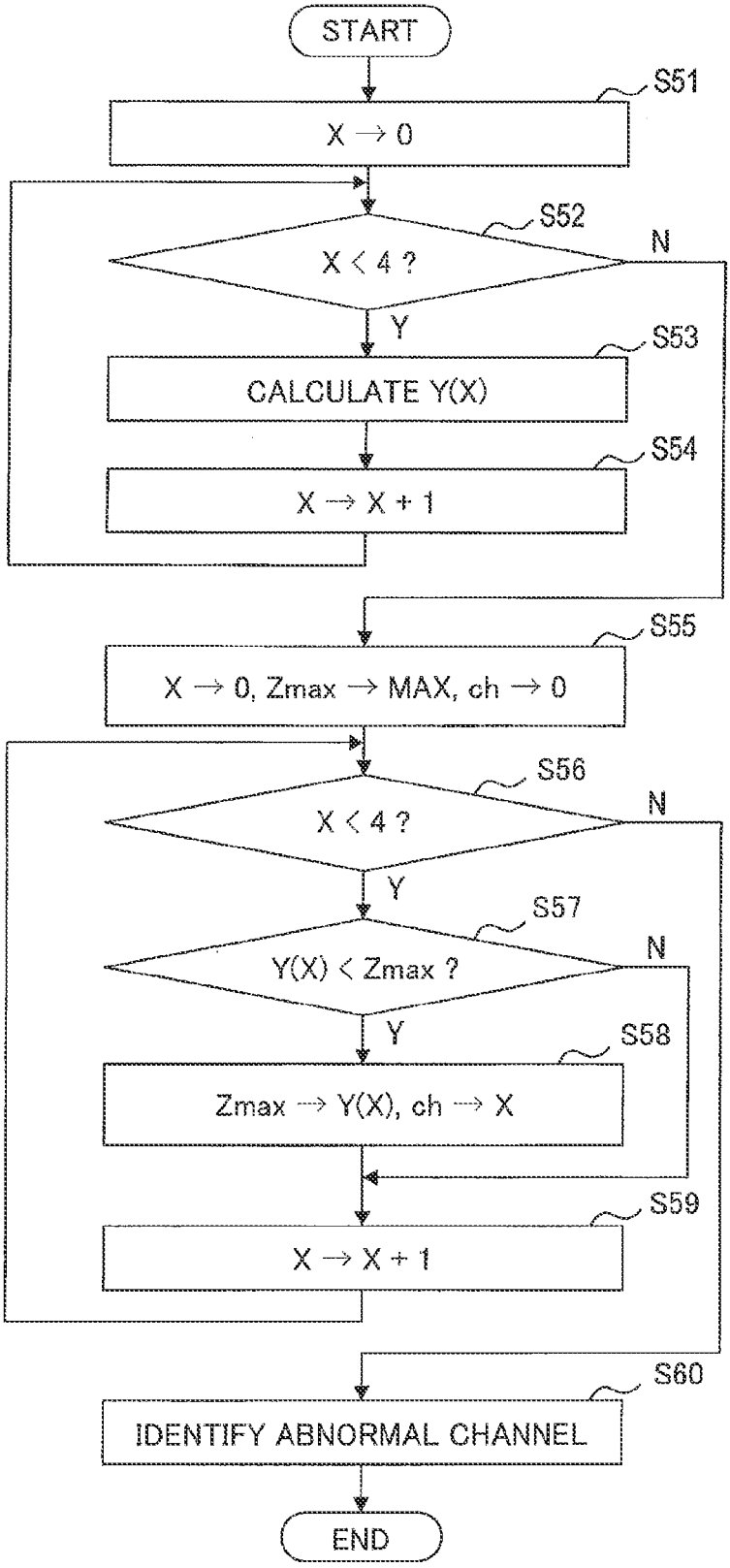
FIG. 5 is a flowchart showing the identification process according to the preferred embodiment.

As the processing of S53 and S57 of FIG. 5, various approaches may be adopted instead of using the difference Y(x). For example, when the abnormal discharge occurs at a charger 117, the output level or the FB level acquired just around the time of the occurrence of the abnormal discharge falls outside predetermined thresholds (between upper and lower limit values) defining a range into which the output level or the FB level acquired in the operation time where the abnormal discharge is not occurring falls.

Figure 6:
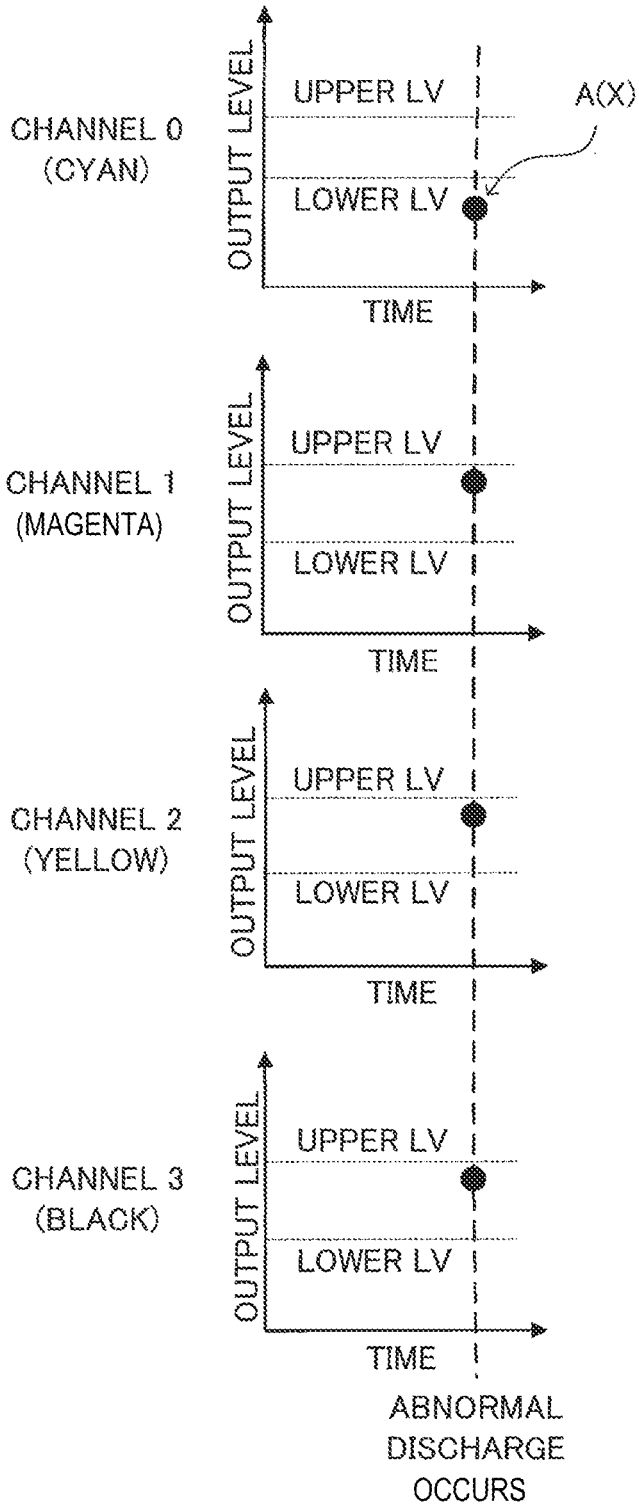
FIG. 6 is an explanation diagram showing a principle of an identification process according to a first variation.

In the example of FIG. 6, the present value A(x) of the FB level of the channel 0 (cyan) falls below the threshold (lower limit value), while the present values A(x) of the FB level of other channels fall within the thresholds, which indicates that the abnormal discharge is occurring at the channel 0.

Figure 7:
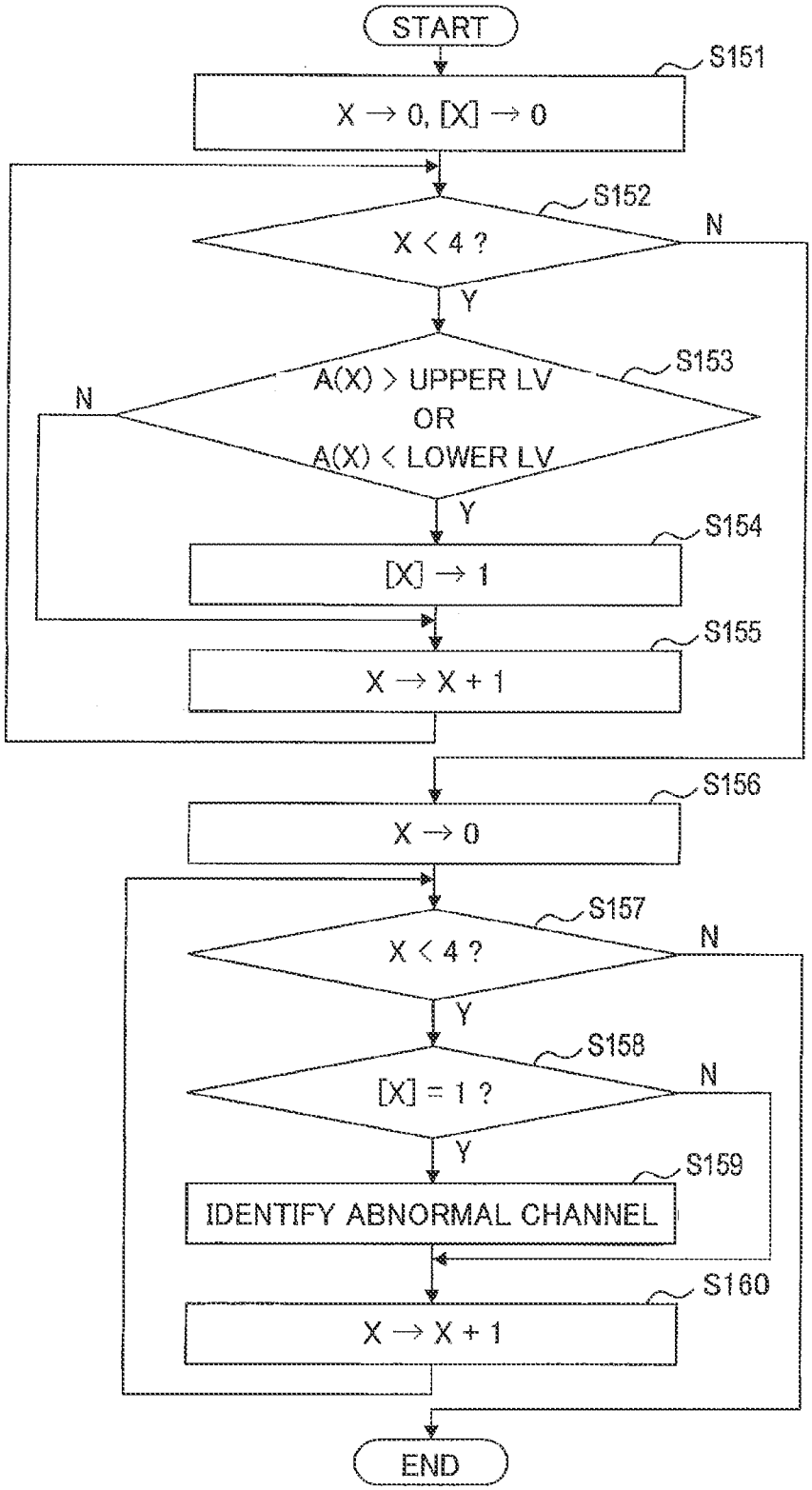
FIG. 7 is a flowchart showing the identification process according to the first variation.

Thus, in S5, a channel in which the abnormal discharge is occurring may be identified as follows. FIG. 7 is a flowchart showing an identification process according to a first variation. First, in S151, the channel number x is set to 0, discharge channel flags [x] given for respective channels are all set to 0. Subsequently, in S152, it is determined whether or not the channel number x is less than 4. In the first time of S152, an affirmative determination is made as in the case of S52 (S152: Y), and the processing flow shifts to S153. In S153, it is determined whether or not the present value A(x) falls above the upper limit value of the threshold or falls below the lower limit value thereof. In either case, that is, when the present value A(x) falls outside the range of the thresholds (S153: Y), in S154 the discharge channel flag [x] of the present channel number x is set to 1, and the processing flow shifts to S155. On the other hand, when the present value A(x) falls within the range of the thresholds (S153:N), the processing flow shifts to S155. In S155, the channel number x is incremented by 1, and the processing flow shifts to the abovementioned S152. When the processing of S153 and S154 has been executed for all of the channel numbers x (=0 to 3) (S152: N), and the processing flow shifts to S156.

In S156, the channel number x is set to 0. Subsequently, in S157, it is determined whether or not the channel number x is less than 4. In the first time of S157, an affirmative determination is made as in the case of S152 (S157: Y), and the processing flow shifts to S158. In S158, it is determined whether or not the discharge channel flag [x] of the present channel number x is set to 1. When the discharge channel flag [x] of the present channel number x is set to 1 (S158: Y), the channel x whose discharge channel flag [x] is set to 1 is identified as the channel in which the abnormal discharge is occurring in S159, and the processing flow shifts to S160. That is, it is determined that the abnormal discharge is occurring in the channel in which the present value A(x) falls outside the range of the thresholds. On the other hand, when the discharge channel flag [x] is not set to 1 (S158: N), the processing shifts to S160. In S160, the channel number x is incremented by 1, and the processing shifts to the abovementioned S157.

The processing of S157 to S160 is executed for all of the channel numbers x (=0 to 3) (S157: N), and the processing flow shifts to the abovementioned S6 (FIG. 3). Then, in S7, the charger 117 corresponding to the colors of the channels in which the abnormal discharge has been determined to occur in S159 of FIG. 7 are displayed on the display unit 100.

In the preferred embodiment, the discharge channel can be identified only by the present value A(x), so that the processing can be simplified and, specifically, the processing of S4 in the main routine illustrated in FIG. 3 can be omitted. Further, in the present embodiment, it becomes possible to detect the abnormal discharge occurring in a plurality of the chargers 117 at the same time.

[Another Identification Processing of Discharge Channel (2)]

Figure 8:
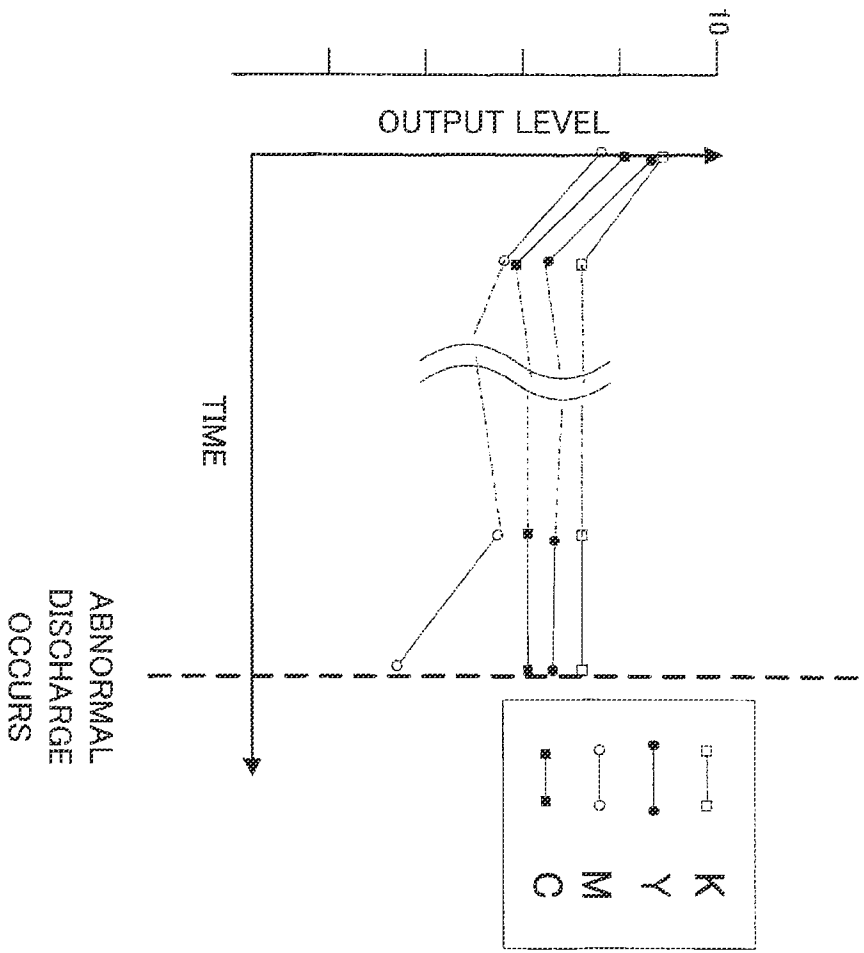
FIG. 8 is an explanation diagram showing a principle of an identification process according to a second variation.

When the abnormal discharge occurs in a given charger 117 (S3: Y), the output level or the FB level acquired just around the time of the occurrence of the abnormal discharge significantly differs from the output level or the FB level of the other chargers 117. In the example of FIG. 8, the output level of the channel 1 (magenta (M)) significantly changes at the time of occurrence of the discharge, that is, significantly becomes different from those of the other channels (yellow (Y), cyan (C), and black (K)). Therefore, at the time point when the abnormal discharge has occurred in any one of the chargers 117 (S3: Y), the output level of each channel as illustrated in FIG. 8 is displayed on the display unit 100. Then, a user may identify the channel 1 (magenta) having relatively the most different value as the other discharge channels based on the displayed data.

Further, the CPU 91 may identify the channel having relatively the most different value from one another among the present values A(x) of magenta (M), yellow (Y), cyan (C), and black (K) stored in the RAM 93. However, it may be difficult for the CPU 91 to make determination based on the present value A(x) of the output level stored in the RAM 93.

Figure 9:
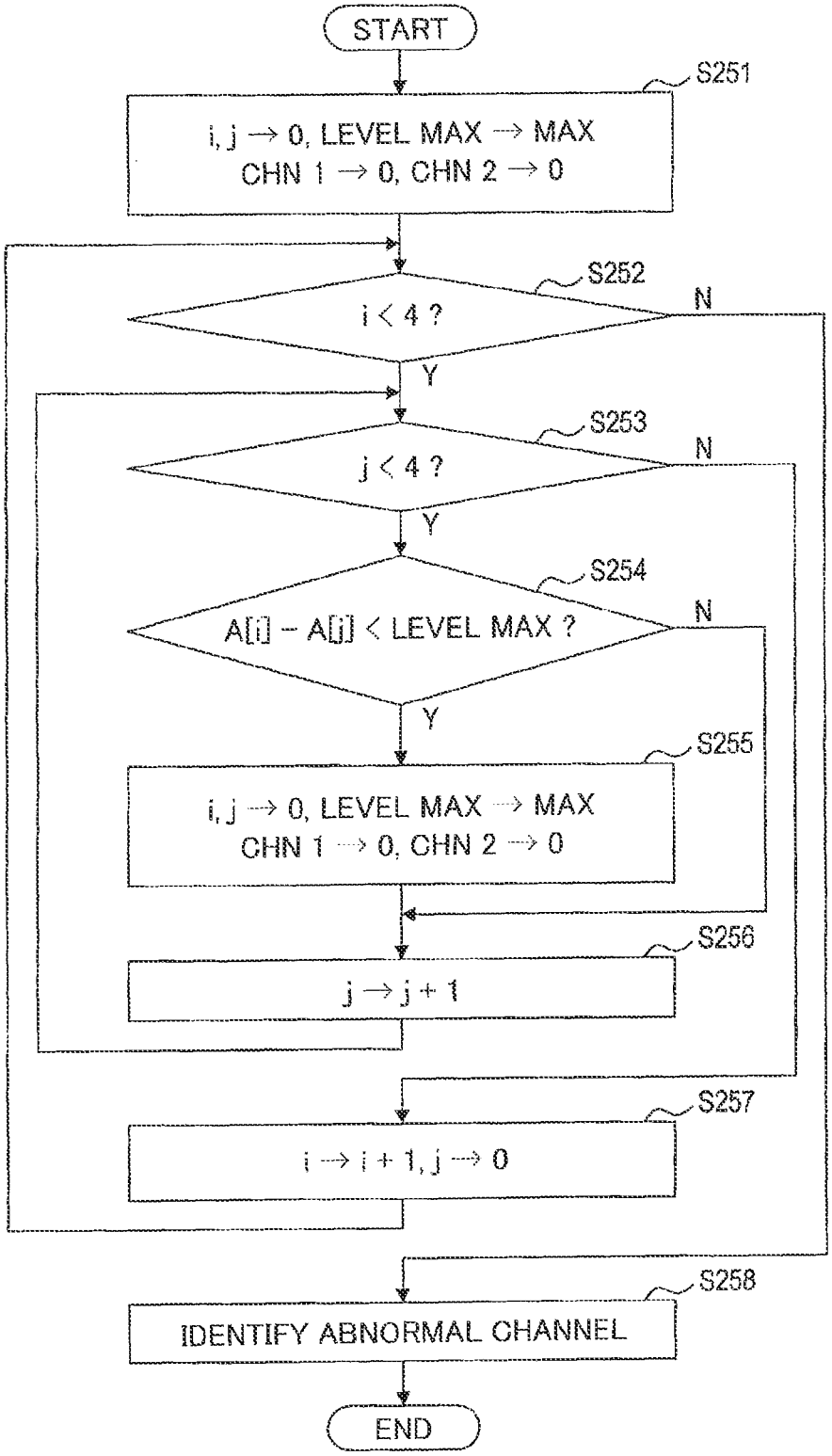
FIG. 9 is a flowchart showing the discharge-channel identification process according to the second variation.

In such case, in S5, a channel in which the abnormal discharge is occurring may be identified as follows. FIG. 9 is a flowchart showing an identification process according to a second variation. First, in S251, the channel numbers i and j are set to 0, a variable "level Max" is set to a maximum value (an assumable value of the present values A[i] and A[j]), and variables "discharge channels 1 and 2" are set to 0. Subsequently, in S252, it is determined whether or not the channel number i is less than 4. In the first time of S252, an affirmative determination is made as in the case of S52 (S252: Y), and the processing flow shifts to S253. In S253, it is determined whether or not the channel number j is less than 4. Also in the first time of S253, an affirmative determination is made (S253: Y), and the processing flow shifts to S254.

In S254, a value obtained by subtracting the present value A[j] from the present value A[i] is calculated, and it is determined whether or not the calculated value is less than the level Max. In the first time of S254, an affirmative determination is made in S254 (S254: Y) since the level Max is initially set to the maximum value in S251, and the processing flow shifts to S255. In S255, the value obtained by subtracting the present value A[j] from the present value A[i] is set to the level Max, the discharge channel 1 is set to i, and the discharge channel 2 is set to j. In S256, the channel number j is incremented by 1, and the processing flow shifts to the abovementioned S253. When the processing of S254 and S255 is thus executed for all of the channel numbers j (=0 to 3) (S253: N), and the processing flow shifts to S257.

In S257, the channel number i is incremented by 1, the channel number j is set to 0, and the processing flow shifts to the abovementioned S253. When the processing of S253 to S257 is executed for all of the channel numbers i (=0 to 3) (S252: N), the value obtained by subtracting the present value A[j] from the present value A[i] has been calculated in S254 for all combinations of i and j (in which the order matters). Then, a combination of i and j having the largest value, that is, the largest difference between the present value A[i] and present value A[j] is stored as the discharge channels 1 and 2.

When a negative determination is made in S252 (S252: N), the processing flow shifts to S258, where channels corresponding to the channel numbers i and j stored as the discharge channels 1 and 2 are identified as the discharge channels, and the processing flow shifts to the abovementioned S6 (FIG. 3). Then, in S7, chargers 117 corresponding to any of the channel colors that have been determined as the discharge channels in which the abnormal discharge is occurring are displayed on the display unit 100.

The two channels stored as the discharge channels 1 and 2 in S257 may be subjected to the processing using the flowchart of FIG. 5. However, the processing according to the flowchart of FIG. 5 is performed for four channels. Therefore, after the number of the target channels are narrowed down to 2 by the execution of the processing according to the flowchart of FIG. 9, the processing according to the flowchart of FIG. 7 may be performed, in order to identify the discharge channel more precisely.

Also in the second variation, the discharge channel can be identified only by the present value A(x), so that the processing can be simplified and, specifically, the processing of S4 in the main routine illustrated in FIG. 3 can be omitted. Although an image forming device of four colors is taken as the above-mentioned example, the present invention may be applied to an image forming device of two or three colors (in the case of the third embodiment, three or more colors).

Although the application voltage of the high-voltage power supply unit 110 is detected by the duty value of the PWM control signal, the application voltage may be detected using an analog signal.

What is claimed is:

1. An image-forming device comprising:

N photoconductors, the N being equal to or greater than 2;

N chargers opposed to the N photoconductors, respectively, each of the N chargers charging the opposed photoconductor with a discharge;

a voltage applying unit configured to apply voltages to the N chargers, individually;

an abnormal discharge detecting unit configured to detect an occurrence of an abnormal discharge at at least one of the N chargers; and a processor configured to:

detect first voltages applied to the N chargers before the occurrence of the abnormal discharge is detected, and second voltages applied to the N chargers after the occurrence of the abnormal discharge is detected;

calculate a difference between the first voltage and the second voltage for each of the N chargers; and identify one charger as a charger at which the abnormal discharge is occurring, the difference between the first voltage and the second voltage applied to the one charger being the greatest among the differences.

2. The image-forming device according to claim 1, further comprising an informing unit configured to inform a user of the identified charger.

3. An image-forming device comprising:

N photoconductors, the N being equal to or greater than 3;

N chargers opposed to the N photoconductors, respectively, each of the N chargers charging the opposed photoconductor with a discharge;

a voltage applying unit configured to apply voltages to the N chargers, individually;

an abnormal discharge detecting unit configured to detect an occurrence of an abnormal discharge at at least one of the N chargers; and a processor configured to:

detect voltages applied to the N chargers at an interval;

calculate a difference between a voltage applied to one charger and a voltage applied to another charger that are detected immediately before or after the occurrence of the abnormal discharge is detected; and identify two chargers as a charger at which the abnormal discharge is occurring, the difference between the voltages applied to the two chargers being the greatest among the differences.

4. The image-forming device according to claim 3, further comprising an informing unit configured to inform a user of the identified two chargers.

5. An image-forming device comprising:

N photoconductors, the N being equal to or greater than 2;

N chargers opposed to the N photoconductors, respectively, each of the N chargers charging the opposed photoconductor with a discharge;

a voltage applying unit configured to apply voltages to the N chargers, individually;

an abnormal discharge detecting unit configured to detect an occurrence of an abnormal discharge at at least one of the N chargers; and a processor configured to:

detect voltages applied to the N chargers at an interval; and identify at least one charger as a charger at which the abnormal discharge is occurring, the voltage applied to the at least one charger being outside a range into which the voltage detected when the discharge is occurring falls.

6. The image-forming device according to claim 5, further comprising an informing unit configured to inform a user of the identified charger.

* * * * *